United States Patent [19]

Berthold et al.

[11] Patent Number: 4,886,737

[45] Date of Patent: Dec. 12, 1989

[54] STABILIZATION OF A PHOTOGRAPHICALLY PRODUCED SILVER IMAGE

[75] Inventors: Werner Berthold; Paul Marx, both of Leverkusen; Hans Öhlschläger, Bergisch-Gladbach, all of Fed. Rep. of Germany

[73] Assignee: Agfa-Gevaert Aktiengesellschaft, Leverkusen, Fed. Rep. of Germany

[21] Appl. No.: 245,558

[22] Filed: Sep. 19, 1988

[30] Foreign Application Priority Data

Oct. 2, 1987 [DE] Fed. Rep. of Germany ..... 3733291

[51] Int. Cl.[4] ..... G03C 7/40

[52] U.S. Cl. ..... 430/372; 430/402; 430/428; 430/429; 430/965

[58] Field of Search ..... 430/356, 402, 428, 429, 430/965, 372

[56] References Cited

U.S. PATENT DOCUMENTS 3,712,818 1/1973 Nittel et al. ..... 430/428

4,760,015 7/1988 Berthold et al. ..... 430/429

*Primary Examiner*—Paul R. Michl

*Assistant Examiner*—Janet C. Baxter

*Attorney, Agent, or Firm*—Connolly & Hutz

[57] ABSTRACT

Photographically produced black and white images (silver images) are stabilized against subsequent destruction of the image silver, in particular due to discoloration, by treating the finished silver image with an aqueous after treatment bath containing aminotetrazole or a mercaptotetrahydrotriazine.

1 Claim, No Drawings

STABILIZATION OF A PHOTOGRAPHICALLY PRODUCED SILVER IMAGE

This invention relates to a process for the stabilization of photographic silver images by a treatment with an aqueous after treatment bath.

In photographic silver images which have been produced by the development and fixing of exposed silver halide emulsion layers, the image tone may shift in the course of time from black to brown or yellow either over the whole surface or in patches.

This change in the image tone may be due to conversion of the silver image into silver sulphide which may occur, for example, if the film or the paper has not been sufficiently washed, after it has been fixed with sodium thiosulphate. A similar troublesome shift in image tone is produced by the action of oxidizing gases on photographic silver images. Oxidation of the image silver produces water soluble silver salts which are liable to diffuse in the material. Photolysis of these soluble silver salts may result in the formation of finely divided yellow to reddish brown colloidal silver or in the formation of brown silver compounds. Such troublesome changes in the completed photographic silver image frequently also occur spotwise in the form of so called microspot defects.

There has been no lack of attempts to prevent or reduce these troublesome changes in photographically produced silver images, for example by ensuring that the chemicals used for processing the imagewise exposed photographic recording materials are washed out more thoroughly or by storing the processed photographic materials, i.e. the silver images, under standardized atmospheric conditions.

Various classes of compounds have also been described for stabilizing finished silver images.

These include acyclic and cyclic thiosemicarbazides (DE-A-No. 20 00 622), heterocyclic mercapto or thio compounds from the series of tetrahydropyrimidines, thiazines and tetrazines (DE-A-No. 20 13 423), organic and inorganic thiocyanates (DE-A-No. 22 18 387) and isothioureas (U.S. Pat. No. 4 500 632). These substances do not satisfy the requirements in practice because their stabilizing action is not sufficient and the photographic properties of the layers are adversely affected.

Processes are known in which the stabilizing additives are directly incorporated in the photographic silver halide material. DE-A-No. 31 51 182 (GB-A-No. 2 090 991) describes the incorporation of polyvinyl imidazole and GB-A-No. 1 156 167 describes the incorporation of sulphoalkyl-substituted hydroquinones.

These substances, however, are required to be used at relatively high concentrations of 0.5 g/m$^2$ to produce sufficient stabilization. The compatibility of the polyvinyl imidazole with silver halide emulsions as well as with wetting agents, stabilizers, developers and auxiliary developers is extremely critical. Moreover, high concentrations in the protective layer result in a loss of gloss.

A process for the stabilization of photographically produced silver images which eliminates the above mentioned disadvantages has now been found. This process uses an after treatment bath containing a certain quantity of aminotetrazole or mercaptotetrahydrotriazine as stabilizing compound.

This invention thus relates to a process for the stabilization of a photographically produced silver image by treatment of the finished silver image with an after treatment bath, characterized in that the after treatment bath contains from 1.5 to 4% by weight of aminotetrazole corresponding to formula I

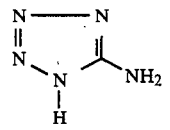

(I)

or a mercaptotetrahydrotriazine corresponding to formula II

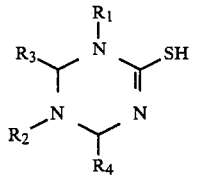

(II)

wherein $R_1$, $R_3$ and $R_4$ denote, independently of one another, hydrogen, saturated or unsaturated, optionally substituted, e.g. phenyl-substituted aliphatic groups with up to 6 carbon atoms, such as methyl, ethyl, propyl, butyl or allyl, or benzyl or phenylethyl or aryl groups, in particular phenyl; and $R_2$ denotes hydrogen, saturated or unsaturated aliphatic groups with up to 6 carbon atoms, such as methyl, ethyl, butyl or allyl, which aliphatic groups are optionally substituted with hydroxyl, alkoxy, amino, halogen or phenyl, such as hydroxymethyl, 2-hydroxypropyl, 2-methoxyethyl, 2-aminoethyl, 3-dimethylaminopropyl, 2-chloroethyl, 3-chloropropyl or benzyl or aryl groups, in particular phenyl.

Suitable examples apart from compound I are those shown below:

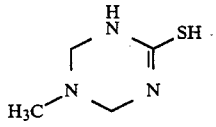

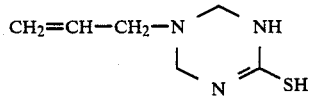

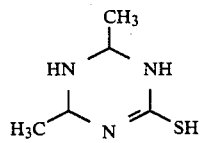

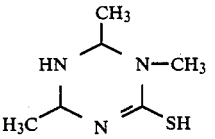

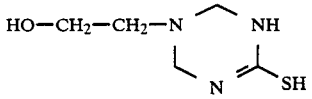

-continued

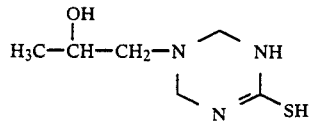

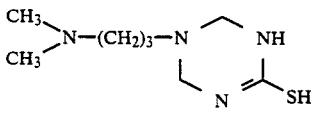

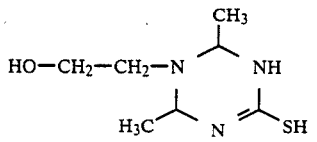

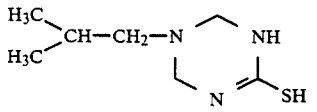

The aminotetrazole used according to the invention is a known compound. The preparation of mercapto tetrahydrotriazines is described in U.S. Pat. No. 3 712 818.

The after treatment bath to be used in the stabilizing process according to the invention consists in the simplest case of a solution of the stabilizing compounds. Aqueous solutions are preferred but solutions in organic solvents or in solvent mixtures of water and organic solvents such as aliphatic alcohols, dimethyl formamide or the like may also be used. The pH of aqueous solutions may be raised or lowered to improve their solubility, e.g. with KOH or with $H_2SO_4$.

The process according to the invention is of the widest applicability to photographic silver images, regardless of the particular method employed for their preparation. Thus, for example, silver images which have been produced by the conventional processes of development and fixing of an exposed photographic material may be stabilized. The images may be conventional continuous tone images, office copies or microfilms. The process according to the invention may also be used to stabilize copies which have been produced by the silver salt diffusion process.

The stabilizing process according to the invention is applied to finished silver images, i.e. silver images which have been obtained photographically by the development of a photographic recording material which contains an imagewise exposed silver halide. In the photographic process, the stage of development may be followed by a stabilizing treatment stage in which the unexposed silver halide is completely or partly removed or converted into a light insensitive form.

Such a stabilizing treatment stage may consist, for example, in subjecting of the developed photographic recording material which already contains the silver image but also a residue of silver halide to a conventional fixing treatment, e.g. in a processing bath containing an alkali metal thiosulphate or ammonium thiosulphate, the silver halide being dissolved out of the photographic material as a soluble silver complex salt. A "stable" silver image is thus produced, the stability of which is due to the virtual absence of light sensitive silver halide in the unexposed areas. This image is referred to in the present context as the finished silver image.

The stabilizing process according to the invention must be distinguished from the above mentioned stabilizing treatment stage. Whereas the latter serves to remove or convert any residues of silver halide still present, the stabilizing process according to the invention only comes into play when the silver image produced is already substantially free from light sensitive silver halide. The finished silver image which is subjected to the stabilizing process according to the invention may also be a silver image which has been produced by the silver salt diffusion process, as already mentioned above. Such a silver image may be produced in a separate image receptor layer optionally containing silver precipitation nuclei but no silver halide.

The after treatment bath according to the invention therefore does not need to contain any substances for removing residues of silver halide.

The after treatment bath according to the invention may contain further additives such as wetting agents, pH modifying agents and antioxidizing agents, e.g. an alkali metal sulphite or a hydroxylamine salt.

The silver image which has been produced by any photographic means is stabilized by the after treatment bath according to the invention so that is is less sensitive to external influences when it is subsequently stored, and in particular it is less sensitive to the action oxidizing gases. This stabilizing effect is to a large extent independent of the particular nature of the photographic material used for the preparation of the silver image, provided this material contains at least one light sensitive silver halide emulsion layer and has been developed by some black and white development process.

The halide contained in the light sensitive silver halide emulsions used in the recording material may be chloride, bromide, iodide or mixtures thereof. In a preferred embodiment, the halide content of at least one layer consists of 0 to 12 mol % of iodide, 0 to 50 mol % of chloride and 50 to 100 mol % of bromide. As a rule, the halides are predominantly compact crystals which may have, for example, a cubical or octahedral form or transitional forms. The crystals may be characterized by the fact that they mainly have a thickness of more than 0.2 μm. The average ratio of diameter to thickness is preferably less than 8:1, the diameter of a grain being defined as the diameter of a circle having an area equal to the projected area of the grain. In another preferred embodiment, all or some of the emulsions may contain mainly tabular silver halide crystals in which the ratio of diameter to thickness is greater than 8:1. The emulsions may be monodisperse or heterodisperse emulsions and preferably have an average grain size of from 0.3 μm to 1.2 μm. The silver halide grains may have a layered grain structure.

The conventional hydrophilic film forming agents may be used as protective colloids or binders for the layers of the recording material, e.g. proteins, in particular gelatine which may, however, be partly or completely replaced by other natural or synthetic binders. Casting auxiliaries and plasticizers may be used; see Research Disclosure 17 643 (December 1978), in particular chapters IX, XI and XII.

The emulsions may be chemically and/or spectrally sensitized in the usual manner. They may contain silver halide stabilizers and the emulsion layers as well as other, light insensitive layers may be hardened with known hardeners in the usual manner. Suitable chemical sensitizers, spectral sensitizing dyes, stabilizers and hardeners are described, for example, in Research Disclosure 17 643; see in particular chapters III, IV, VI and X.

The recording materials which are to be subjected to the stabilizing process according to the invention are exposed imagewise to ultraviolet light, visible light or infra-red light or to a high energy radiation. This is followed by conventional processing to convert the exposed silver halide into image silver. This is generally carried out by treating the recording material in an alkaline medium in the presence of a silver halide developer compound which may be present in one of the layers of the recording material or in an aqueous treatment bath. Inorganic or organic developer compounds may be used. Examples include hydroquinone, 3-pyrazolidone, aminophenol and derivatives thereof; see Research Disclosure 17 643, chapter XX. Development is generally followed by treatment in a fixing bath whereby the unexposed and undeveloped silver halide is dissolved out of the recording material.

Although the stabilizing process according to the invention may be carried out at any time after development and production of the silver image, it is most effective when applied as the last treatment stage before drying of the black and white image. This means that the stabilizing bath according to the invention is preferably not followed by any further liquid treatment, and especially not by washing. The stabilizing bath according to the invention is in fact used after treatment bath or final bath.

EXAMPLE

Various samples of an exposed, developed, fixed and thoroughly washed photographic black and white material, preferably in the form of "step wedges", were washed and then bathed for 3 minutes in a solution of one of the compounds shown in the following table and dried. The after treated, dried black and white materials were exposed to a very dilute hydrogen peroxide atmosphere at an adjusted relative atmospheric humidity of 84%. This hydorgen peroxide atmosphere was produced by the hydrolysis of sodium percarbonate $Na_2CO_3.3H_2O_2$ at a relative humidity of 84% and at room temperature (22° to 24° C.). The relative humidity of 84% was adjusted by means of a saturated KBr solution. The exposed and processed paper strips were suspended vertically in a rectangular glass vessel of about 20 liters. The glass vessel was inside a tempered water bath for adjusting the temperature inside the vessel to 22°-24° C. The vessel was closed with an opaque glass plate. The samples to be investigated were exposed to a fluorescent lamp (Xenon lamp 22 watt) through this glass plate at a distance of about 20 cm. About 50 g of percarbonate were uniformly distributed over the bottom of the glass vessel. In each test, the dried samples were kept in the glass vessel until at least one of them had been severely attacked according to the following scale of assessment:

No attack: no recognisable discolouration

Slight attack: slight discolouration predominantly at low density

Moderate attack: moderate discolouration at low or high density

Severe attack: severe discolouration at low and high density up to complete bleaching.

The results and effects of the individual compounds are summarised in the table below.

The soluble and colourless silver compounds which are formed when the silver image is destroyed are rendered insoluble by the stabilizer bath according to the invention. It was surprisingly found that the compounds claimed have an excellent effect, as may be seen from the table.

| Compound and Concentration | Duration of Test in Weeks | Discolourations of silver image |
|---|---|---|
| 1% | 3 | Severe at low densities |
| 2% | 6 | Slight at low densities |
| 3% | 12 | None |
| 5% | 12 | Slight at low densities |
| 1% | 3 | Moderate at low densities |
| 2% | 9 | None |
| 3% | 9 | Slight at low densities |

We claim:

1. In the photographic process of stabilizing a finished photographic silver image obtained from a silver halide emulsion layer, by exposing, developing, fixing and washing the emulsion the step of treating said emulsion in an after-treatment bath comprising a solution of aminotetrazole of the following formula:

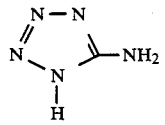

said aminotetrazole being present in the bath in a concentration of from 1.5 to 4% by weight.

* * * * *

UNITED STATES PATENT AND TRADEMARK OFFICE

CERTIFICATE OF CORRECTION

PATENT NO. : 4,886,737

DATED : December 12, 1989

INVENTOR(S) : WERNER BERTHOLD, ET AL.

It is certified that error appears in the above-identified patent and that said Letters Patent is hereby corrected as shown below:

Column 2, line 41, Please insert identifying numeral -- 1 -- next to the formula shown in lines 41-46.

Column 2, line 49, Please insert identifying numeral -- 2 -- next to the formula shown in lines 49-52.

Column 2, line 53, Please insert identifying numeral -- 3 -- next to the formula shown in lines 53-57.

Column 2, line 58, Please insert identifying numeral -- 4 -- next to the formula shown in lines 58-63.

Column 2, line 65, Please insert identifying numeral -- 5 -- next to the formula shown in lines 65-68.

Column 3, line 3, Please insert identifying numeral -- 6 -- next to the formula shown in lines 3-7.

UNITED STATES PATENT AND TRADEMARK OFFICE

CERTIFICATE OF CORRECTION

PATENT NO. : 4,886,737

DATED : December 12, 1989

INVENTOR(S) : WERNER BERTHOLD, ET AL.

It is certified that error appears in the above-identified patent and that said Letters Patent is hereby corrected as shown below:

Column 3, line 9, Please insert identifying numeral -- 7 -- next to the formula shown in lines 9-12.

Column 3, line 14, Please insert identifying numeral -- 8 -- next to the formula shown in lines 14-18.

Column 3, line 20, Please insert identifying numeral -- 9 -- next to the formula shown in lines 20-23.

Column 4, line 26, "is is" should read -- it is --.

Column 5, line 42, "hydorgen" should read -- hydrogen --.

UNITED STATES PATENT AND TRADEMARK OFFICE

CERTIFICATE OF CORRECTION

PATENT NO. : 4,886,737

DATED : December 12, 1989

INVENTOR(S) : WERNER BERTHOLD, ET AL.

It is certified that error appears in the above-identified patent and that said Letters Patent is hereby corrected as shown below:

Column 6, line 27, Please insert compound number -- 1 -- to the left of "1%".

Column 6, line 31, Please insert compound number -- 2 -- to the left of "1%".

Signed and Sealed this

Twenty-third Day of April, 1991

*Attest:*

*Attesting Officer*

HARRY F. MANBECK, JR.

*Commissioner of Patents and Trademarks*